US007370489B2

(12) United States Patent
Rios et al.

(10) Patent No.: US 7,370,489 B2
(45) Date of Patent: May 13, 2008

(54) CASING ASSEMBLY SUITABLE FOR USE IN A HEAT EXCHANGE ASSEMBLY

(75) Inventors: Arturo Rios, Avon, IN (US); Thomas K. Rembold, Danville, IN (US); Jason M. Thomas, Morgantown, IN (US); Stephen R. Carlisle, Indianapolis, IN (US); Floyd J. Frenia, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 190 days.

(21) Appl. No.: 11/337,157

(22) Filed: Jan. 20, 2006

(65) Prior Publication Data

US 2007/0169500 A1 Jul. 26, 2007

(51) Int. Cl.
*F25D 21/14* (2006.01)

(52) U.S. Cl. ..... 62/285; 62/291

(58) Field of Classification Search ..... 62/272, 62/285, 288, 289, 291; 165/DIG. 195, DIG. 198
See application file for complete search history.

(56) References Cited

U.S. PATENT DOCUMENTS 3,823,770 A 7/1974 Duell et al.
4,129,013 A 12/1978 Hine, Jr.
4,205,653 A 6/1980 Pickering
4,473,107 A 9/1984 Fairbrother et al.
5,279,360 A * 1/1994 Hughes et al. ..... 165/111
5,448,986 A 9/1995 Christopher et al.
5,613,554 A * 3/1997 Bull et al. ..... 165/150
5,664,430 A * 9/1997 Karman ..... 62/285
5,715,697 A 2/1998 Rust, Jr. et al.
5,904,053 A 5/1999 Polk et al.
6,196,015 B1 * 3/2001 Pignolo ..... 62/285
6,286,328 B1 * 9/2001 Kawahara ..... 62/285
6,289,688 B1 * 9/2001 da Luz Moraes et al. .... 62/285
6,305,379 B1 * 10/2001 Wolfinbarger, Jr. ..... 128/898
6,494,199 B1 12/2002 Zia et al.
6,539,727 B1 * 4/2003 Burnett ..... 62/78
6,701,740 B1 * 3/2004 Hernandez-Zelaya ..... 62/291
6,912,766 B2 7/2005 Wendt et al.
6,978,909 B2 * 12/2005 Goetzinger et al. ..... 220/571

* cited by examiner

*Primary Examiner*—Mohammad M. Ali
(74) *Attorney, Agent, or Firm*—Kinney & Lange, P.A.

(57) ABSTRACT

A casing assembly suitable for use in a heat exchange assembly includes a first cover, and a second cover adjacent to the first cover. A sealing mechanism positioned between the first and second covers provides a substantially airtight seam between the first and second covers.

20 Claims, 5 Drawing Sheets

Z
X
Y
110
101
18A
18
18B
53A
103A
53B
103B
102
100
104
108
38A
38
38B
106

CASING ASSEMBLY SUITABLE FOR USE IN A HEAT EXCHANGE ASSEMBLY

CROSS-REFERENCE TO RELATED APPLICATION(S)

The following application is filed on the same day as the following co-pending applications: "CASING ASSEMBLY SUITABLE FOR USE IN A HEAT EXCHANGE ASSEMBLY" by inventors Floyd J. Frenia, Arturo Rios, Thomas K. Rembold, Michael V. Hubbard, Jason Michael Thomas, and Stephen R. Carlisle (application Ser. No. 11/336,278); "CONDENSATE PAN INSERT" by inventors Jason Michael Thomas, Floyd J. Frenia, Thomas K. Rembold, Arturo Rios, Michael V. Hubbard, and Dale R. Bennett (application Ser. No. 11/336,626); "METHOD AND SYSTEM FOR VERTICAL COIL CONDENSATE DISPOSAL" by inventors Thomas K. Rembold, Arturo Rios, Jason Michael Thomas, and Michael V. Hubbard (application Ser. No. 11/336,382); "CASING ASSEMBLY SUITABLE FOR USE IN A HEAT EXCHANGE ASSEMBLY" by inventors Arturo Rios, Thomas K. Rembold, Jason Michael Thomas, Stephen R. Carlisle, and Floyd J. Frenia (application Ser. No. 11/337,157); "LOW-SWEAT CONDENSATE PAN" by inventors Arturo Rios, Floyd J. Frenia, Thomas K. Rembold, Michael V. Hubbard, and Jason Michael Thomas (application Ser. No. 11/336,648); "CONDENSATE PAN INTERNAL CORNER DESIGN" by inventor Arturo Rios (application Ser. No. 11/337,107); "VERTICAL CONDENSATE PAN WITH NON-MODIFYING SLOPE ATTACHMENT TO HORIZONTAL PAN FOR MULTI-POISE FURNACE COILS" by inventor Arturo Rios (application Ser. No. 11/337,100); "CONDENSATE SHIELD WITH FASTENER-FREE ATTACHMENT FOR MULTI-POISE FURNACE COILS" by inventor Arturo Rios (application Ser. No. 11/336,381); and "SPLASH GUARD WITH FASTENER-FREE ATTACHMENT FOR MULTI-POISE FURNACE COILS" by inventor Arturo Rios (application Ser. No. 11/336,651), which are incorporated herein by reference.

BACKGROUND

The present invention relates to a casing assembly. More particularly, the present invention relates to a casing assembly suitable for use in a heat exchange assembly, such as an evaporator assembly.

In a conventional refrigerant cycle, a compressor compresses a refrigerant and delivers the compressed refrigerant to a downstream condenser. From the condenser, the refrigerant passes through an expansion device, and subsequently, to an evaporator. The refrigerant from the evaporator is returned to the compressor. In a split system heating and/or cooling system, the condenser may be known as an outdoor heat exchanger and the evaporator as an indoor heat exchanger, when the system operates in a cooling mode. In a heating mode, their functions are reversed.

In the split system, the evaporator is typically a part of an evaporator assembly coupled with a furnace. However, some cooling systems are capable of operating independent of a furnace. A typical evaporator assembly includes an evaporator coil (e.g., a coil shaped like an "A", which is referred to as an "A-frame coil") and a condensate pan disposed within a casing. An A-frame coil is typically referred to as a "multi-poise" coil because it may be oriented either horizontally or vertically in the evaporator assembly.

During a cooling mode operation, a furnace blower circulates air into the casing of the evaporator coil assembly, where the air cools as it passes over the evaporator coil. The blower then circulates the air to a space to be cooled. Depending on the particular application, an evaporator assembly including a vertically oriented A-frame coil may be an up flow or a down flow arrangement. In an up flow arrangement, air is circulated upwards, from beneath the evaporator coil assembly, whereas in a down flow arrangement, air is circulated downward, from above the evaporator coil assembly.

Refrigerant is enclosed in piping that is used to form the evaporator coil. If the temperature of the evaporator coil surface is lower than the dew point of air passing over it, the evaporator coil removes moisture from the air. Specifically, as air passes over the evaporator coil, water vapor condenses on the evaporator coil. The condensate pan of the evaporator assembly collects the condensed water as it drips off of the evaporator coil. The collected condensation then typically drains out of the condensate pan through a drain hole in the condensate pan.

BRIEF SUMMARY

The present invention is a casing assembly suitable for use in a heat exchange assembly. The casing assembly includes a body, and first and second covers that are attached to the body. A first sealing mechanism positioned between the first and second covers provides a substantially airtight seam between the first and second covers. In one embodiment, the first sealing mechanism is a first gasket positioned along a first portion of the first cover, where the first gasket interfaces with the second cover to form the substantially airtight seam. The first cover of the casing assembly defines an opening configured to receive a drain connection of a condensate pan. A second sealing mechanism positioned between the first cover and the drain connection of the condensate pan provides a substantially airtight interface therebetween. In one embodiment, the second sealing mechanism includes a lip surrounding at least a part of an outer perimeter of the opening in the first cover, where the lip is configured to engage with a second gasket surrounding the drain connection.

DETAILED DESCRIPTION

Figure 1A:
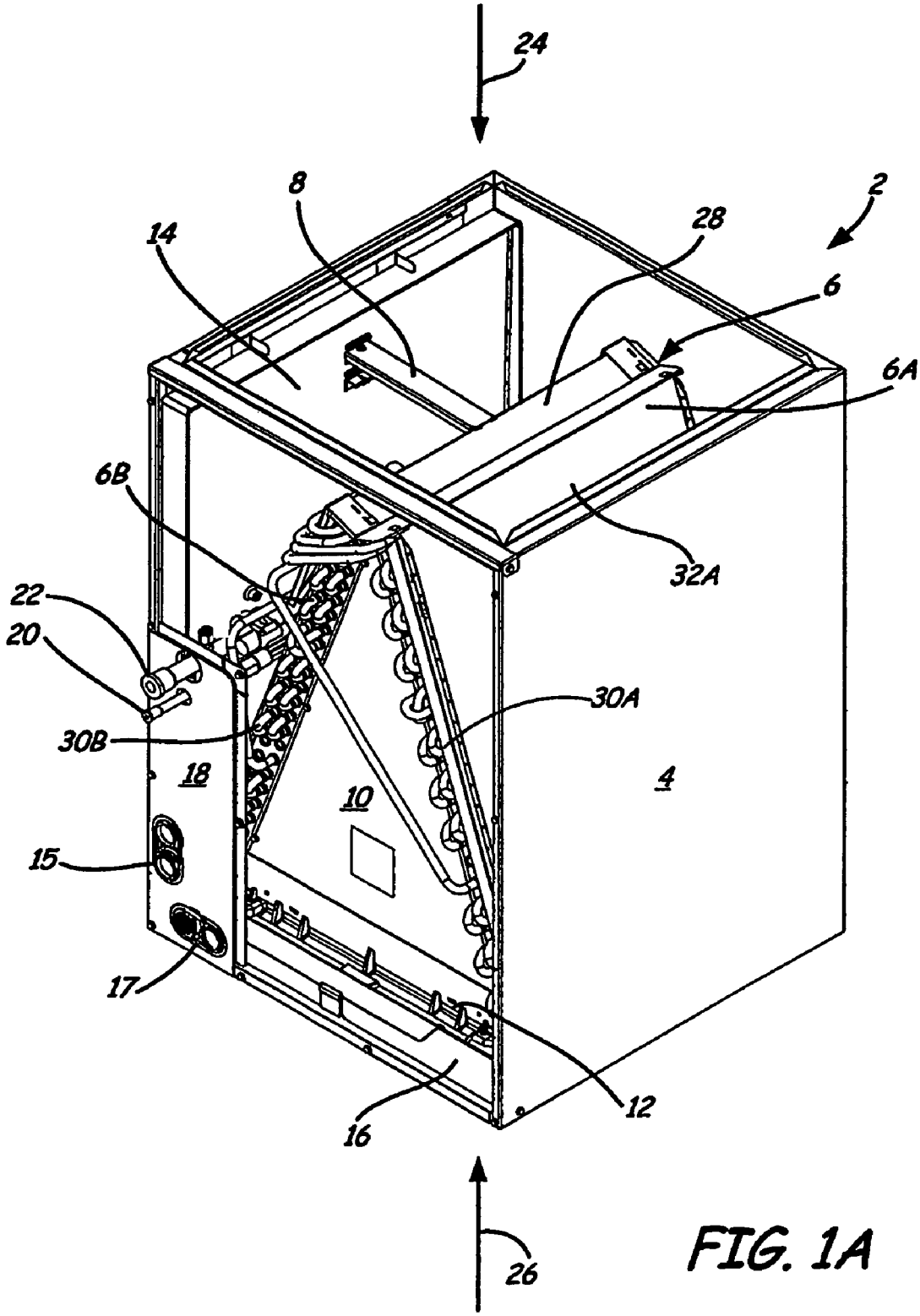
FIG. 1A is a perspective view of an evaporator assembly, which includes an evaporator coil and condensate pan disposed within a casing.

FIG. 1A is a perspective view of evaporator assembly 2, which includes casing 4, A-frame evaporator coil ("coil") 6, coil brace 8, first delta plate 10, second delta plate 12, horizontal condensate pan 14, drain holes 15 (also referred to as a "drain connection"), vertical condensate pan 16, drain holes 17 (also referred to as a "drain connection"), first cover 18, input refrigerant line 20, and output refrigerant line 22. When evaporator assembly 2 is integrated into a heating and/or cooling system, evaporator assembly 2 is typically mounted above an air handler. The air handler includes a blower that cycles air through evaporator assembly 2. In a down flow application, the blower circulates air in a downward direction (indicated by arrow 24) through casing 4 and over coil 6. In an up flow application, the blower circulates air in an upward direction (indicated by arrow 26) through casing 4.

Coil 6, condensate pan 14, and condensate pan 16 are disposed within casing 4, which is preferably a substantially airtight space for receiving and cooling air. That is, casing 4 is preferably impermeable to air except for openings 4A and 4B (shown in FIG. 1B). In a down flow application, air is introduced into evaporator assembly 2 through opening 4A and exits through opening 4B. In an up flow application, air is introduced into evaporator assembly 2 through opening 4B and exits through opening 4A. In the embodiment shown in FIGS. 1A and 1B, casing 4 is constructed of a single piece of sheet metal that is folded into a three-sided configuration, and may also be referred to as a "wrapper". In alternate embodiments, casing 4 may be any suitable shape and configuration and/or formed of multiple panels of material.

Figure 1B:
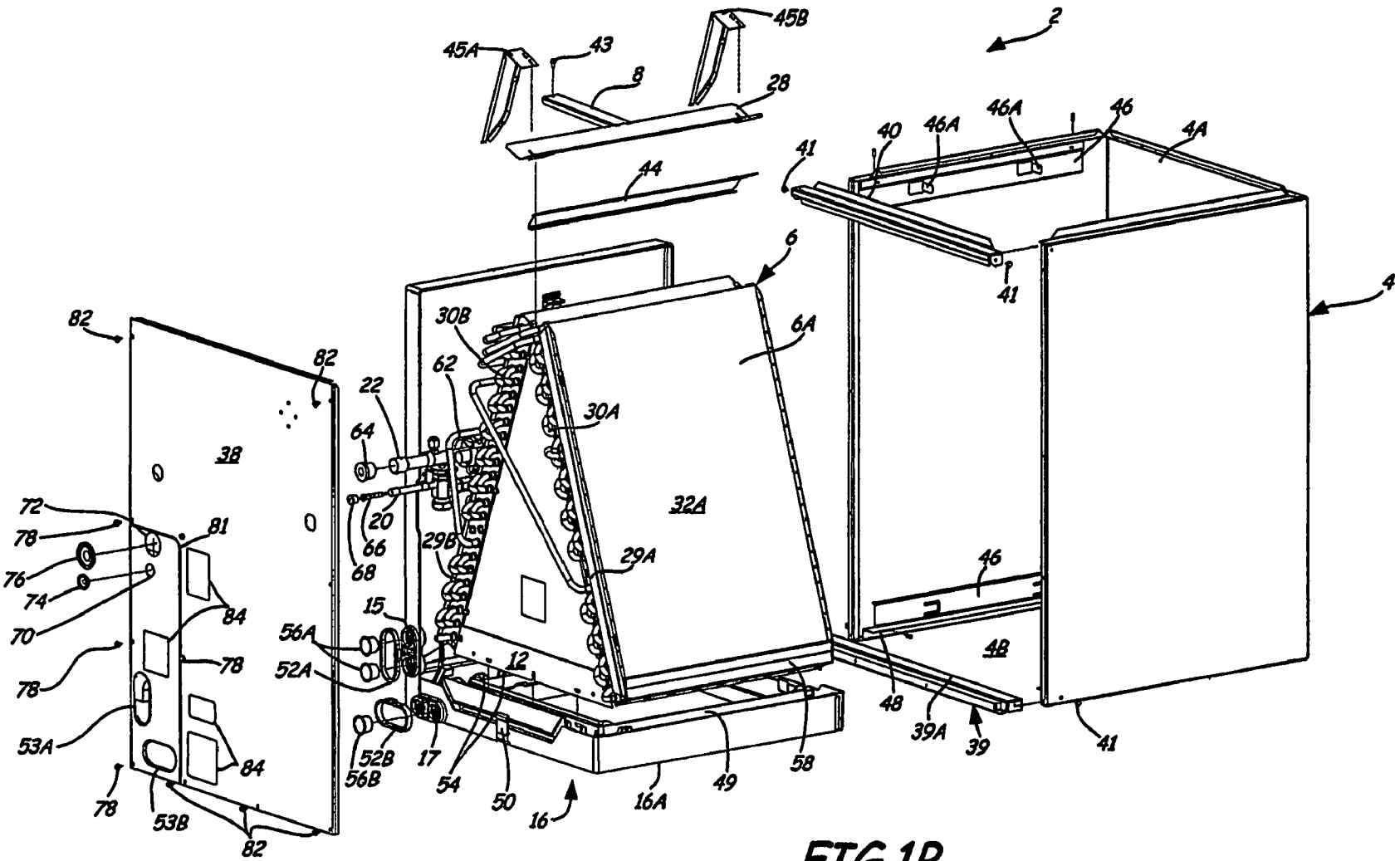
FIG. 1B is an exploded perspective view of the evaporator assembly of FIG. 1A.

Coil 6 is a multi-poise A-frame coil, and may be oriented either horizontally or vertically. The vertical orientation is shown in FIGS. 1A and 1B. In a horizontal orientation, casing 4 is rotated 90° in a counterclockwise direction. Coil brace 8 is connected to air seal 28 and helps supports coil 6 when coil 6 is in its horizontal orientation.

Coil 6 includes first slab 6A and second slab 6B connected by air seal 28. A gasket may be positioned between air seal 28 and first and second slabs 6A and 6B, respectively, to provide an interface between air seal and slabs 6A and 6B that is substantially impermeable to water. First and second delta plates 12 and 14, respectively, are positioned between first and second slabs 6A and 6B, respectively. First slab 6A includes multiple turns of piping 30A with a series of thin, parallel fins 32A mounted on piping 30A. Similarly, second slab 6B includes multiple turns of piping 30B with a similar series of thin, parallel fins mounted on piping 30B. Tube sheet 29A is positioned at an edge of slab 6A, and tube sheet 29B is positioned at an edge of slab 6B. Delta plates 10 and 12, and air seal 28 may be attached to tube sheets 29A and 29B.

In the embodiment shown in FIG. 1A, coil 6 is a two-row coil. However, in alternate embodiments, coil 6 may include any suitable number of rows, such as three, as known in the art. Refrigerant is cycled through piping 30A and 30B, which are in fluidic communication with one another (through piping system 62, shown in FIG. 1B). As FIG. 1A illustrates, coil 6 includes input and output lines 20 and 22, respectively, which are used to recycle refrigerant to and from a compressor (which is typically located in a separate unit from evaporator assembly 2). Refrigerant input and output lines 20 and 22 extend through first cover 18. Evaporator assembly 2 also includes access cover 38 (shown in FIG. 1B) adjacent to first cover 18, and together, first cover 18 and access cover 38 fully cover the front face of evaporator assembly 2 (i.e., the face which includes first cover 18). First cover 18 and access cover 38 are formed of any suitable material, such as steel. Access cover 38 will be described in further detail in reference to FIG. 1B.

As discussed in the Background section, if the temperature of coil 6 surface is lower than the dew point of the air moving across coil 6, water vapor condenses on coil 6. If coil 6 is horizontally oriented, condensation from coil 6 drips into condensate pan 14, and drains out of condensate pan 14 through drain holes 15, which are typically located at the bottom of condensate pan 14. If coil 6 is vertically oriented, condensate pan 16 collects the condensed water from coil 6, and drains the condensation through drain holes 17, which are typically located at the bottom of condensate pan 16.

Because evaporator assembly 2 includes horizontal condensate pan 14 and vertical condensate pan 16, evaporator assembly 2 is configured for applications involving a horizontal or vertical orientation of coil 6. In an alternate embodiment, evaporator assembly 2 is modified to be applicable to only a vertical orientation of coil 6, in which case horizontal condensate pan 14 and brace 8 are absent from evaporator assembly 2. In another alternate embodiment, evaporator assembly 2 excludes vertical condensate pan 16 such that evaporator assembly 2 is only applicable to horizontal orientations of coil 6.

FIG. 1B is an exploded perspective view of evaporator assembly 2 of FIG. 1A. Front deck 39 and upper angle 40 are each connected to casing 4 with screws 41. Another suitable method of connecting front deck 39 and upper angle 40 to casing 4 may also be used, such as welding, an adhesive or rivets. Front deck 39 and upper angle 40 provide structural integrity for casing 4 and provide a means for connecting first cover 18 and access cover 38 to casing 4. Screw 43 attaches brace 8 (and thereby, air seal 28) to horizontal condensate pan 14. Of course, other suitable means of attachment may be used in alternate embodiments. In addition to air seal 28, air splitter 44 is positioned between first slab 6A and second slab 6B of coil 6, and is attached by tabs on tube sheets 29A and 29B of coil 6.

Horizontal and vertical condensate pans 14 and 16 are typically formed of a plastic, such as polyester, but may also be formed of any material that may be casted, such as metal (e.g., aluminum). Horizontal condensate pan 14 slides into casing 4 and is secured in position by pan supports 46. Tabs 46A of pan supports 46 define a space for condensate pan 14 to slide into. When coil 6 is in a horizontal orientation (and casing 4 is rotated about 90° in a counterclockwise direction), coil 6 is positioned above horizontal condensate pan 14 so that condensation flows from coil 6 into horizontal condensate pan 14. Air splitter 44 and splash guards 45A and 45B also help guide condensation from coil 6 into horizontal condensate pan 14.

Condensation that accumulates in horizontal condensate pan 14 eventually drains out of horizontal condensate pan 14 through drain holes 15. Gasket 52A is positioned around drain holes 15 prior to positioning first cover 18 over drain holes 15 in order to help provide a substantially airtight seal between drain holes 15 and first cover 18. First cover 18 includes opening 53A, which corresponds to and is configured to fit over drain holes 15 and gasket 52A. The substantially airtight seal helps prevent air from escaping from casing 4, and thereby increases the efficiency of evaporator assembly 2. Caps 56A may be positioned over one or more drain holes 15, such as when evaporator assembly 2 is used in an application in which coil 6 is vertically oriented.

Vertical condensate pan 16 slides into casing 4 and is supported, at least in part, by flange 48, which is formed by protruding sheet metal on three-sides of casing 4 and top surface 39A of front deck 39. Specifically, bottom surface 16A of condensate pan 16 rests on flange 48 and top surface 39A of front deck 39. Condensate pan 16 includes outer perimeter 49, insert 50, drain holes 17 (which are sealed by gasket 52B) and plurality of ribs 54.

One or more channels are positioned about outer perimeter 49 of vertical condensate pan 16 for receiving condensation from coil 6. In the vertical orientation of coil 6 illustrated in FIGS. 1A and 1B, coil 6 is positioned above vertical condensate pan 16 to allow condensation to flow along one slab 6A or 6B and eventually into one or more of the channels along outer perimeter 49 of vertical condensate pan 16. In this way, condensation collects in condensate pan 16. In some applications, such as when coil 6 includes three rows of coils, insert 50 is positioned in condensate pan 16 to help shield coil 6 from condensate blow off from condensate pan 16.

Evaporator assembly 2 includes features, such as ribs 54 and shield 58, that are configured to help direct condensation into the one or more channels along outer perimeter 49 of vertical condensate pan 16 (when coil 6 is vertically oriented). Shield 58 is attached to tube sheet 29A and is configured to both guide condensation into a channel along outer perimeter 49 of condensate pan 16 and help protect coil 6 from condensation blow-off, which occurs when condensation that is collected in condensate pan 16 is blown into the air stream moving through evaporator assembly 2. A similar shield is attached to tube sheet 29B.

Condensation that accumulates in vertical condensate pan 16 eventually drains out of vertical condensate pan 16 through drain holes 17. Gasket 52B is positioned around drain holes 17 prior to positioning first cover 18 over drain holes 17 in order to help provide a substantially airtight seal between drain holes 17 and first cover 18. First cover 18 includes opening 53B, which corresponds to and is configured to fit over drain holes 17 and gasket 52B. The airtight seal helps prevent air from escaping from casing 4, and thereby increases the efficiency of evaporator assembly 2. Cap 56B may be positioned over one or more drain holes 17.

Piping system 62 fluidically connects piping 30A of first slab 6A and piping 30B of second slab 6B. Refrigerant flows through piping 30A and 30B, and is recirculated from and to a compressor through inlet and outlet tubes 20 and 22, respectively. Specifically, refrigerant is introduced into piping 30A and 30B through inlet 20 and exits piping 30A and 30B through outlet 22. As known in the art, refrigerant inlet 20 includes rubber plug 64, and refrigerant outlet 22 includes strainer 66 and rubber plug 68. Inlet 20 protrudes through opening 70 in first cover 18 and outlet 22 protrudes through opening 72 in first cover 18. By protruding through first cover 18 and out of casing 4, inlet 20 and outlet 22 may be connected to refrigerant lines that are fed from and to the compressor, respectively. Gasket 74 is positioned between inlet 20 in order to provide a substantially airtight seal around opening 70. Similarly, gasket 76 is positioned around outlet 22.

Figure 2:
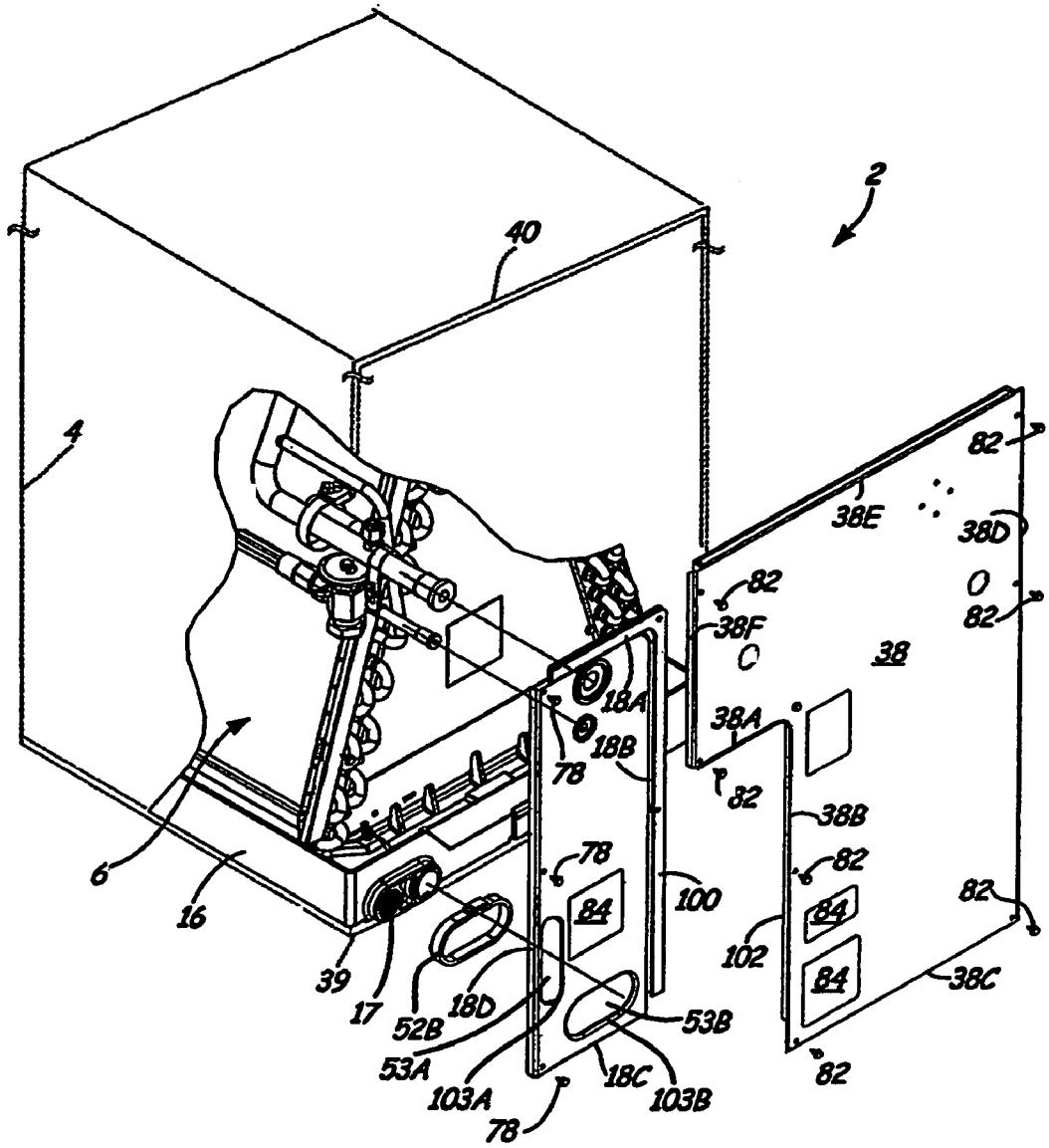
FIG. 2 is an exploded partial perspective view of a front face of the evaporator assembly of FIG. 1A, illustrating a casing, upper angle, front deck, a first cover and an access cover.

FIG. 2 is an exploded partial perspective view of a front face of evaporator assembly 2 of FIGS. 1A and 1B, and illustrating casing 4 (in phantom), coil 6, vertical condensate pan 16, first cover 18, access cover 38, front deck 39 (in phantom), and upper angle 40 (in phantom). Horizontal condensate pan 14 has been removed from FIG. 2 for clarity of illustration. Together, casing 4, first cover 18, and access cover 38 define a casing assembly in accordance with the present invention. First cover 18 includes first portion 18A, second portion 18B, third portion 18C, and fourth portion 18D. Access cover 38 includes first portion 38A, second portion 38B, third portion 38C, fourth portion 38D, fifth portion 38E, and sixth portion 38F. First cover 18 is attached to casing 4, access cover 38, and front deck 39 using a plurality of screws 78 and 82. Specifically, first portion 18A of first cover 18 abuts first portion 38A of access cover 38, and is attached thereto with screws 82. Second portion 18B of first cover 18 abuts second portion 38B of access cover 38, and is attached thereto with screws 82. Third portion 18C of first cover 18 is attached to casing 4 with screw 78, while fourth portion 18D is attached to casing 4 with screws 78. In alternate embodiments, other means of attachment are used, such as welding, an adhesive or rivets.

Access cover 38 is attached to casing 4, first cover 18, front deck 39, and upper angle 40 with a plurality of screws 82. More specifically, first and second portions 38A and 38B of access cover 38 are attached to first cover 18 with screws 82, and third portion 38C of access cover 38 is attached to front deck 39 with screws 82. Fourth and sixth portion 38D and 38F, respectively, of access cover 38 is attached to casing 4 using screws 82, and fifth portion 38E of access cover 38 contacts upper angle 40. In alternate embodiments, other means of removably attaching access cover 38 to casing 4, first cover 18, front deck 39, and upper angle 40 are used. Access cover 38 is preferably removably attached in order to provide access to coil 6, condensate pan 16, and other components inside casing 4 for maintenance purposes. One or more labels 84, such as warning labels, may be placed on first cover 18 and/or access cover 38.

First and second portions 18A and 18B of first cover 18 abut first and second portions 38A and 38B of access cover 38, respectively, thereby defining seam 81 (shown in FIG. 1B). Seam 81 may also be referred to as a "joint". In order to help increase the efficiency of evaporator assembly 2, gaps created at seam 81 are minimized in order to minimize or eliminate air loss. In accordance with the present invention, a sealing mechanism is positioned between first cover 18 and access cover 38 at seam 81 in order to minimize or eliminate potential air gaps. In the embodiment of evaporator assembly 2 illustrated in FIG. 2, the sealing mechanism at seam 81 includes gasket 100, which is attached to flange 101 (shown in FIG. 4) that extends from first and second portions 18A and 18B, respectively, of first cover 18. When access cover 38 is attached to first cover 18, gasket 100 pushes against and interfaces with first and second portions 38A and 388B of access cover 38 to form a substantially airtight seal at seam 81.

In the embodiment shown in FIG. 2, gasket 100 is a neoprene gasket has a thickness T of about 2 millimeters. In alternate embodiments, a thickness of gasket 100 may be modified and gasket 100 may be any seal or packing that helps prevent the escape of a fluid through seam 81, and may be, for example, other deformable pads of material.

First cover includes lips 103A and 103B. Lip 103B, which extends around an outer perimeter of opening 53B in first cover 18, engages with gasket 52B (positioned between drain holes 17 and opening 53B) to provide a substantially airtight seal between opening 53B in first cover 18 and drain holes 17 in vertical condensate pan 16. Gasket 52B is positioned between lip 103B and drain holes 17 when first cover 18 is attached to casing 4. As previously discussed, a similar gasket 52A (shown in FIG. 1B) is positioned between drain holes 15 and opening 53A in first cover 18. Lip 103A around a part of the outer perimeter of opening 53A (shown in FIG. 1B) similarly engages with gasket 52A (shown in FIG. 1B) to provide a substantially airtight seal between opening 53A in first cover 18 and drain holes 15 in horizontal condensate pan 14.

Figure 3:
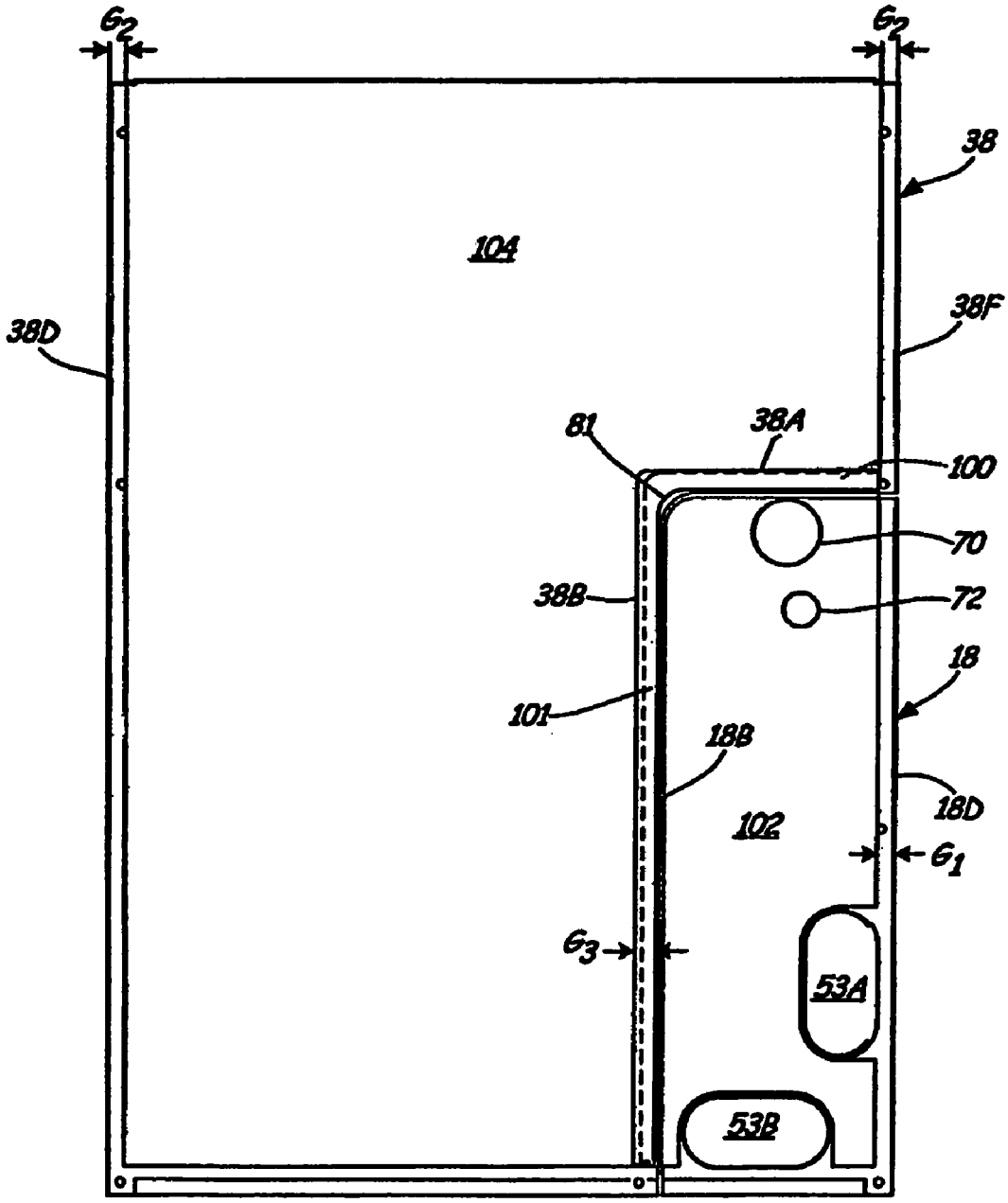
FIG. 3 is a plan view of a rear side of the first cover and access cover of FIG. 2, illustrating a gasket and insulation, which are disposed on the rear side of the first cover and access cover.

FIG. 3 is a plan view of a rear side (i.e., opposite the front side shown in FIG. 2) of first cover 18, which abuts access cover 38 to define seam 81. Flange 101 extends from first and second portions 18A and 18B of first cover 18. Gasket 100 (shown in phantom) is attached to a front side of flange 101 (i.e., on an opposite side of flange 101 from the view shown in FIG. 3), such that gasket 100 is in between first cover 18 and access cover 38.

Openings 70 and 72 for refrigerant inlet 20 and outlet 22 (shown in FIGS. 1A and 1B), as well as drain openings 15 and 17, extend through first cover 18. Insulation 102 is attached to a rear side of first cover 18 and insulation 104 is attached to a rear side of access cover 38. Gap $G_1$ between insulation 102 and fourth portion 18D of first cover 18 provides room to receive casing 4 such that first cover 18 does not protrude significantly therefrom. Gaps $G_2$ between insulation 104 and fourth and sixth portions 38D and 38F, respectively, of access cover 38 similarly provide room for access cover 38 to attach to casing 4. Flange 101 is positioned in gap $G_3$ between second portion 18B of first cover 18 and insulation 104. Insulation 102 and 104 are used to increase the efficiency of evaporator assembly 2 by insulating casing 4 from exterior environmental conditions in order to help maintain a temperature within the interior of casing 4 within a preferred range.

Figure 4:
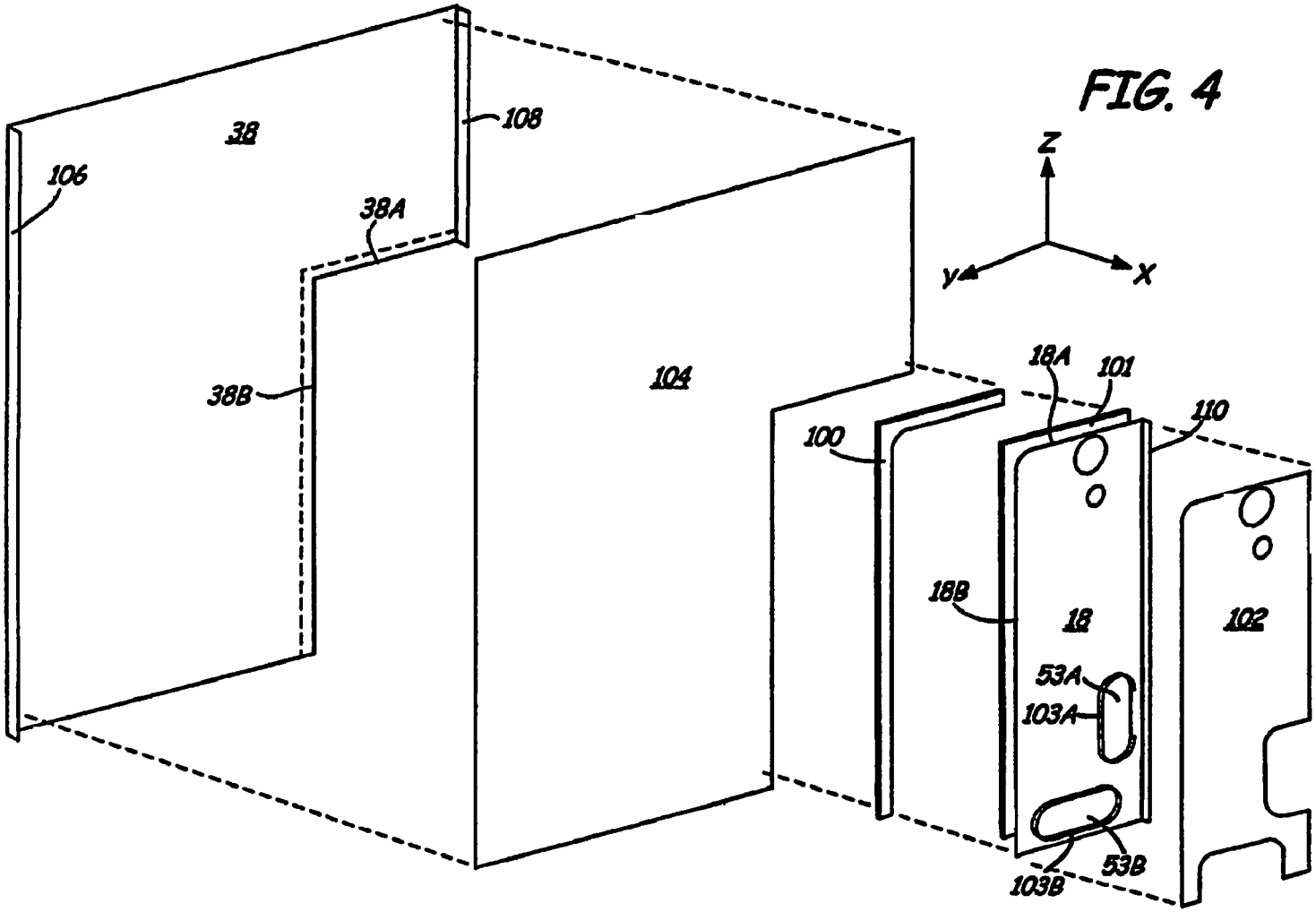
FIG. 4 is a schematic exploded view of the rear side of the casing assembly of FIG. 3.

FIG. 4 is a schematic exploded view of the rear side of first cover 18, access cover 38, gasket 100, and insulation 102 and 104. Insulation 102 attaches to the rear side of first cover 18, which attaches to gasket 100. Insulation 104 attaches to the rear side of access cover 38. Finally, first cover 18 and gasket 100 attach to access cover 38.

Access cover 38 includes extensions 106 and 108, which are configured to wrap around casing 4 and securely fit access cover 38 to casing 4. First cover 18 also includes extension 110, which is configured to wrap around casing 4. As the assembly lines in FIG. 3 illustrate, insulation 104 is attached to a rear side of access cover 38.

Gasket 100 is aligned to attach to a front surface of flange 101 of first cover 18. Flange 101 extends from first and second portions 18A and 18B of first cover 18 and protrudes slightly therefrom in an x-axis direction (where orthogonal x-y-z coordinates are shown in FIG. 3) in order to provide room for gasket 100 (i.e., such that gasket 100 does not protrude in the x-axis direction a significant amount relative to first cover 18). Flange 101 interfaces with access cover 38 and overlaps with first and second portions 38A and 38B, respectively, of access cover 38 (as shown in phantom on access cover 38). Because gasket 100 is attached to the front surface of flange 101, gasket 100 is sandwiched between flange 101 and access cover 38 when access cover 38 and first cover 18 are attached.

FIG. 4 also illustrates lips 103A and 103B protruding from first cover 18. Lip 103A does not fully extend around an outer perimeter of opening 53A in order to provide room for first cover 18 to attach to casing 4. If lip 103A fully extended around the outer perimeter of opening 53A, lip 103A would prevent first cover 18 from lying flush with casing 4.

While the present invention has been described with reference to evaporator unit 2, a casing assembly including a sealing mechanism positioned between a first cover and an access cover in accordance with the present invention is suitable for use with any heat exchange assembly.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A casing assembly suitable for use in an evaporator assembly, the casing assembly comprising:

a body;

a first cover attached to the body and defining a first opening configured to receive a drain connection of a condensate pan, the first cover comprising a first portion;

a lip positioned around at least a part of the first opening and configured to engage with a first gasket to substantially seal an interface between the first opening and the drain connection of the condensate pan;

a flange extending from the first portion of the first cover;

a second gasket attached to the flange; and a second cover overlapping with at least a part of the flange and including a second portion, wherein the first portion of the first cover and the second portion of the second cover define a seam, the second gasket cooperating with the second cover to substantially seal the seam.

2. The casing assembly of claim 1, the body comprising:

a wrapper including a first panel, a second panel, and a third panel;

a upper angle extending from the first panel to the third panel of the wrapper; and a front deck extending from first panel to the third panel of the wrapper and positioned on an opposite end of the wrapper from the upper angle, wherein the first cover abuts the upper angle and the wrapper, and the second cover abuts the upper angle, the wrapper, and the front deck.

3. The casing assembly of claim 2, wherein the upper angle and the front deck are substantially parallel.

4. The casing assembly of claim 2, wherein the wrapper is formed of a single sheet of material.

5. The casing assembly of claim 4, wherein the material is metal.

6. The casing assembly of claim 1, wherein the second cover is removably attached to the body.

7. The casing assembly of claim 1, wherein the first and second gaskets are each formed of neoprene.

8. The casing assembly of claim 1, the first cover further defining:

a second opening configured to receive a first pipe;

a first seal surrounding the second opening;

a third opening configured to receive a second pipe; and a second seal surrounding the third opening.

9. The casing assembly of claim 8, wherein the first pipe is an input refrigerant pipe and the second pipe is an output refrigerant pipe.

10. The casing assembly of claim 8, wherein the first seal is a third gasket and the second seal is a fourth gasket.

11. The casing assembly of claim 1, wherein the lip extends around at least a part of an outer perimeter of the opening in the first cover.

12. The casing assembly of claim 1, wherein the flange is integral with the first cover.

13. A casing assembly suitable for use in a heat exchange assembly, the casing assembly comprising:

a first cover comprising:

an opening configured to receive a drain connection of a condensate pan, the opening comprising a lip configured to engage with a first gasket positioned around an outer perimeter of the drain connection;

a second cover abutting the first cover to define a seam; and a sealing mechanism disposed at the seam, the sealing mechanism comprising:

a second gasket disposed between the first cover and the second cover.

14. The casing assembly of claim 13, wherein the first and second gaskets are each formed of neoprene.

15. The casing assembly of claim 1, and further comprising:

a flange extending from the first cover, wherein the second gasket is attached to the flange.

16. An evaporator assembly comprising:

a casing assembly comprising:

a wrapper;

a first cover attached to the wrapper and defining a first opening including an outer perimeter;

a lip extending around at least a part of the outer perimeter of the first opening;

a second cover attached to the wrapper and adjacent to the first cover; and a first sealing mechanism configured to provide a substantially airtight seam between the first and second covers;

an evaporator coil disposed within the casing assembly;

a condensate pan positioned to collect condensation from the evaporator coil and including a drain connection configured to align with the first opening in the first cover; and a second sealing mechanism configured to substantially seal an interface between the outer perimeter of the first opening and the drain connection of the condensate pan.

17. The evaporator assembly of claim 16, wherein the first sealing mechanism comprises:

a gasket positioned between the first and second covers.

18. The evaporator assembly of claim 17, wherein the casing assembly further comprises:

a flange extending from the first cover and at least partially covered by the second cover, the gasket being attached to the flange.

19. The evaporator assembly of claim 16, the first cover comprising:

a second opening configured to receive a first pipe;

a first gasket surrounding the second opening;

a third opening configured to receive a second pipe; and a second gasket surrounding the third opening.

20. The evaporator assembly of claim 16, wherein the lip is integral with the first cover.

* * * * *